US006098583A

United States Patent [19]

Gordon

[11] Patent Number: 6,098,583

[45] Date of Patent: Aug. 8, 2000

[54] TOOL FOR USE IN ADJUSTING INTERNAL COMBUSTION ENGINE VALVES

[76] Inventor: Gregory H. Gordon, 381 Collins Dr., #6, Merced, Calif. 95348

[21] Appl. No.: 09/294,534

[22] Filed: Apr. 19, 1999

[51] Int. Cl.[7] ..... F01M 11/00

[52] U.S. Cl. ..... 123/90.38; 123/195 C; 184/6.27

[58] Field of Search ..... 123/90.33, 90.37, 123/90.38, 195 C, 196 R, 198 E; 184/6.27

[56] References Cited

U.S. PATENT DOCUMENTS

| | | | |
|---|---|---|---|
| 3,568,799 | 3/1971 | Bivins | 123/90.38 |
| 4,538,560 | 9/1985 | Alden | 123/90.38 |
| 5,095,860 | 3/1992 | Newell | 123/90.38 |
| 5,492,086 | 2/1996 | Kuhns | 123/90.38 |
| 5,884,594 | 3/1999 | Wiehle | 123/90.38 |

*Primary Examiner*—Weilun Lo
*Attorney, Agent, or Firm*—Flehr Hohbach Test Albritton & Herbert LLP; Richard E. Backus

[57] ABSTRACT

A valve adjusting tool for use with internal combustion engines of the V-8 type. A valve cover is adapted for releasably mounting on the valve head, and an elongate opening is formed through the top of the cover with the opening being sufficiently large to enable ingress of valve adjusting devices. Within the cover a plurality of deflector structures are mounted with each structure having a deflecting surface which projects across the paths of spray from oiler holes so as to redirect the oil spray and avoid egress of the spray through the opening.

4 Claims, 1 Drawing Sheet

TOOL FOR USE IN ADJUSTING INTERNAL COMBUSTION ENGINE VALVES

BACKGROUND OF THE INVENTION

1. Field of the Invention

This invention relates in general to engine valve adjusting tools, and more particularly relates to a tool which enables a mechanic to dynamically adjust the valve rockers of an internal combustion engine without excessive oil spray or oil runover.

2. Description of the Related Art

The mechanism for operating valves of certain internal combustion engines, for example small V-8 block engines for Chevrolet automobiles in the model years 1957 and up, present a number of problems when the valve rockers are dynamically adjusted to obtain the proper valve lash. These engines have valve heads which carry a plurality of reciprocating push rods, rocker arms which pivot responsive to reciprocation of the push rods, and valve stems which operate the valves responsive to pivoting of the rocker arms. Lubricating oil for the valve mechanism is supplied through bore holes in the push rods which spray out through oiler holes formed in sockets of the rocker arms in which the upper ends of the push rods are mounted. Normally the spray is directed upwardly and then deflects off the inner surface of a valve cover which is mounted on the head.

When it is required to adjust the valves, the conventional procedure is for the mechanic to remove the valve cover so as to provide access to use wrenches and other adjusting tools. In order to dynamically adjust the valve rockers the engine must be running, and the engine oil pressure can range from 40 psi to 100 psi. This pressure causes the rocker arm oiler holes to produce oil sprays of up to 3 feet from the engine, resulting in excessive oil runover and spillage, as well as possible injury to the mechanic or damage to property while adjusting the valve lash. The oil spray can foul the engine compartment, engine block, starter and exhaust manifolds, and also soil the mechanic's hands, arms and clothing. The excessive oil spray also reaches the adjusting tools, resulting in an unsafe condition because it is then more difficult for the mechanic to maintain a firm grip on the tools. Excessive oil spray also makes it more difficult for the mechanic to visibly check the valves, rockers and push rods to detect worn or defective parts, and also makes it more difficult to check for rounded cam lobes. The excessive oil on the engine parts, including the spark plugs, plug wires and starter, increases fire hazard. The oil spray can also reach and foul other parts of the automobile such as fender covers, as well as the floor of the shop, garage or driveway where the engine is being serviced.

The need has therefore been recognized for a valve adjusting tool which obviates the foregoing and other limitations and disadvantages of prior art adjusting tools. Despite the various valve adjusting tools in the prior art, there has heretofore not been provided a suitable and attractive solution to these problems.

OBJECTS AND SUMMARY OF THE INVENTION

It is a general object of the invention to provide a new and improved tool for use in dynamically adjusting the valves of an internal combustion engine of the type having a valve mechanism which includes push rods, rocker arms, valve stems and oiler holes which spray oil within a valve cover.

Another object is to provide a tool for use in adjusting valves of an internal combustion engine of the type described which obviates the various problems of excessive oil spray and oil runover when the valve cover is removed to gain access for dynamically adjusting the valve rockers to obtain proper valve lash.

The invention in summary provides a valve cover which is releasably mounted on the valve head of an internal combustion engine. The cover is formed with an elongate opening which extends over rocker arms that form a part of the engine's valve mechanism. The opening is sufficiently large to enable ingress of valve adjusting devices. A plurality of deflector structures are carried by the valve cover, and each deflector structure has a deflecting surface which projects across paths of spray from oiler holes in the push rods for redirecting the spray to avoid egress of the spray through the opening.

The foregoing and additional objects and features of the invention will appear from the following specification in which the preferred embodiments of the invention have been set forth in detail in conjunction with the accompanying drawings.

DESCRIPTION OF THE PREFERRED EMBODIMENTS

Figure 1:
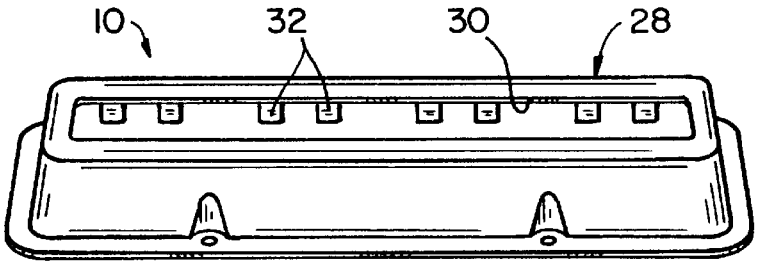
FIG. 1 an isometric view of a valve cover incorporating a preferred embodiment of the invention.
Figure 2:
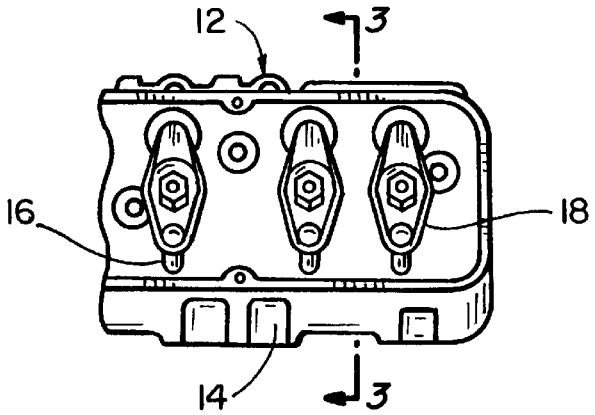
FIG. 2 is a fragmentary top plan view of a valve head for an internal combustion engine with which the valve cover of FIG. 1 can be used.
Figure 3:
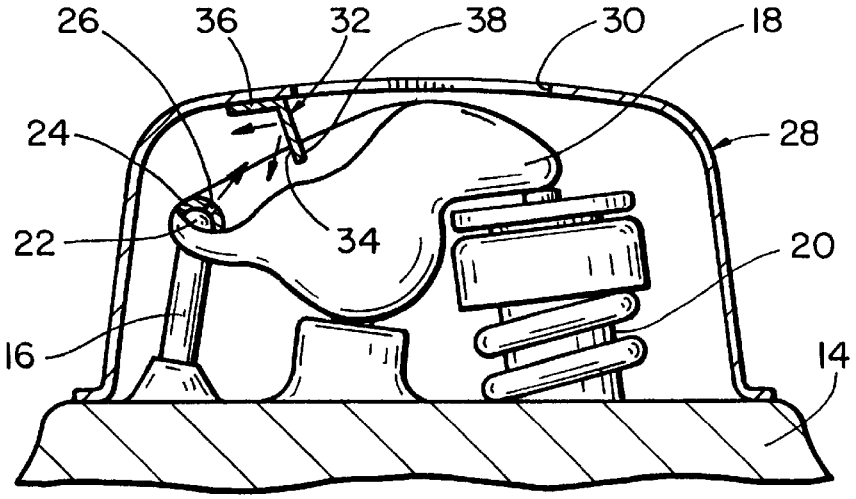
FIG. 3 is a cross sectional view, to an enlarged scale, through the engine block of FIG. 2 and showing the valve cover of FIG. 1 mounted in place for use in adjusting valves.

In the drawings FIG. 1 illustrates generally at 10 a valve adjusting tool in accordance with a preferred embodiment of the invention. Tool 10 is adapted for use with an internal combustion engine 12 (FIG. 2) of V-8 configuration, and is particularly adapted for use in adjusting the valves on small block V-8 Chevrolet engines from the model year 1957 and up. The drawing FIGS. 2 and 3 illustrate the valve head 14 on one side of the engine where the centerline of the valve head would incline at an angle from vertical.

The valve operating components of the engine are conventional. Each valve head carries a plurality of reciprocating push rods 16 together with rocker arms 18 which pivot responsive to the push rods and valve stems 20 which operate the valves responsive to pivoting of the rocker arms. A valve cover (not shown) is bolted atop each valve head to enclose the valve operating mechanism during normal operation of the engine.

The valve operating mechanism of each valve head is lubricated by a supply of oil which is directed upwardly under pressure through channels formed by axial bores in the push rods 16. The upper end of each push rod is formed with a semi-spherical end 22 which fits within a socket 24 of the corresponding rocker arm. The oil exits from each push rod through end 22 and sprays upwardly through a small diameter oiler hole 26 formed in socket 24. During normal engine operation the oil spray deflects downwardly from the inner surface of the oil cover for lubricating the valve operating mechanism. For dynamically adjusting the valve rockers the cover is conventionally taken off, and this objectionably enables the oil to spray on to the engine, mechanic and surrounding area.

For dynamically adjusting the valves, tool 10 of the invention is bolted onto either of the valve heads after the conventional valve cover is removed. The tool is comprised of a valve cover 28 which is formed with an elongate opening 30 that extends over portions of the rocker arms when the tool is bolted to the valve head. The tool can advantageously be made by cutting the opening in a valve cover which is obtained either by salvage or as a spare part made by an original equipment manufacturer (OEM). The OEM valve cover typically is made of metal; and the cover which comprises the tool of the invention could be made of metal or other suitable materials such as high temperature plastic, rubber, steel or aluminum. Opening 30 is made sufficiently large to enable ingress of valve adjusting devices, such as a ratchet wrench and valve lash gauges. For this purpose the opening can be on the order of 1⅜" wide by 16¾" long.

A valve cover gasket, not shown, made of cork or hard rubber, could be used in mounting the cover to the valve head.

Tool 10 further includes a plurality of deflector structures 32 which are carried by the valve cover. Each deflector structure is positioned above a respective rocker arm and is formed with deflecting surface 34 which projects across the path of spray from the oiler hole at an angle which is sufficient to redirect the spray along a direction which substantially avoids egress of the spray through the opening. In the preferred embodiment deflector structure 32 is comprised of a flat plate which is bent to form proximal and distal ends 36 and 38 which diverge at an interior angle on the order of 70°. The deflector structures could be made of metal or a suitable high temperature flexible rubber material. The proximal end of each deflector structure is mounted on the inner wall of cover 28 adjacent the side of opening 30 which is on the high, or intake, side of the valve head. At this mounting position the distal ends project downwardly in the orientation shown in FIG. 3 so that these ends act as deflecting surfaces which redirect the spray away from the opening. The deflector structures can be fastened to the cover by suitable means such epoxy glue, metal screws or rivets.

With tool 10 mounted on the valve head and the engine running, the mechanic can dynamically adjust the valve rockers to obtain the proper valve lash without excessive oil spray and runover because the sides and top portions of cover along the opening in combination with the deflector structures confine the oil spray within the cover. This keeps the engine compartment, engine block, starter and exhaust manifolds free from oil spillage. Excessive oil spray onto the mechanic's hands, arms and chest is also avoided. The ratchet wrench and extension tools are free of fresh oil for ensuring a safe grip. Vacuum hoses, plug wires and other electrical wires are kept from being caught or tangled in the valve springs and rocker arms. The avoidance of excessive oil loss also will produce less smoke for clear visibility while reducing fire hazard. The shop floor or driveway where the work is being done is also kept clear from fresh oil leakage for personnel safety and for reducing injury to property.

Another advantage in minimizing oil loss is that the proper engine oil level is maintained to reduce or eliminate premature wear due to low oil levels. The invention also allows the mechanic to have sufficient time to properly adjust valve lash without being rushed due to excessive smoke and engine oil spillage. Furthermore, the mechanic can more easily see to visibly check the valves, rockers and push rods and detect worn or defective parts, and also to check for rounded cam lobes.

While the foregoing embodiments are at present considered to be preferred it is understood that numerous variations and modifications may be made therein by those skilled in the art without departing from the invention and it is intended to cover in the appended claims all such variations and modifications as fall within the true spirit and scope of the invention.

What claimed is:

1. A tool for use in adjusting the valves of an internal combustion engine of the type having a valve head which carries a plurality of reciprocating push rods, rocker arms which pivot responsive to reciprocation of the push rods, valve stems which operate the valves responsive to pivoting of the rocker arms, and a plurality of oiler holes in the rocker arms, the oiler holes receiving a supply of oil from bore holes in the push rods and directing a spray of the oil along paths over the rocker arms, the tool comprising a valve cover releasably mounted on the valve head, the valve cover comprising a top wall having side portions which are space apart to define an elongate opening with a width which is sufficient to enable the side portion of the top wall to redirect portions of the oil spray away from the opening, the opening being sufficiently large to enable ingress of valve adjusting devices, a plurality of deflector structures fixedly attached to the tog wall, each deflector structure having a deflecting surface, the deflector structures being positioned so that the deflecting surfaces project across said paths of spray from the oiler holes at angles which are sufficient to redirect other portions of the spray away from the opening, and the valve cover below the top wall being devoid of apertures which allow escape of oil from within the cover.

2. A tool as in claim 1 in which each deflector structure comprises a plate.

3. A tool as in claim 2 in which the valve cover has an inner surface, and the plate of each deflector structure is mounted on the inner surface of the top wall.

4. A tool as in claim 1 in which the deflecting surfaces project substantially orthogonal with said paths of the spray.

* * * * *